US010795288B2

(12) United States Patent
Okabe et al.

(10) Patent No.: US 10,795,288 B2
(45) Date of Patent: Oct. 6, 2020

(54) IMAGE FORMING APPARATUS WITH CONTROLLER CONTROLLING FIXING AND TRANSFER MEMBERS

(71) Applicant: FUJI XEROX CO., LTD., Tokyo (JP)

(72) Inventors: Masafumi Okabe, Kanagawa (JP); Kanji Watanabe, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/225,487

(22) Filed: Dec. 19, 2018

(65) Prior Publication Data

US 2019/0146383 A1 May 16, 2019

Related U.S. Application Data

(63) Continuation of application No. 15/592,292, filed on May 11, 2017, now Pat. No. 10,168,646.

(30) Foreign Application Priority Data

Sep. 28, 2016 (JP) ..... 2016-189213

(51) Int. Cl.
*G03G 15/16* (2006.01)
*G03G 15/00* (2006.01)

(52) U.S. Cl.
CPC ..... *G03G 15/1615* (2013.01); *G03G 15/5054* (2013.01); *G03G 15/6517* (2013.01)

(58) Field of Classification Search
CPC ..... G03G 15/1615; G03G 15/5054; G03G 15/6517
See application file for complete search history.

(56) References Cited

U.S. PATENT DOCUMENTS 4,377,333 A * 3/1983 Tsuji ..... G03G 15/6529 399/122
5,023,667 A * 6/1991 Negoro ..... G03G 15/164 399/317
5,063,416 A * 11/1991 Honda ..... B41J 15/06 226/24

(Continued)

FOREIGN PATENT DOCUMENTS

JP 2008-185638 A 8/2008
JP 2014-127569 A 7/2014

(Continued)

*Primary Examiner* — David J Bolduc
(74) *Attorney, Agent, or Firm* — Sughrue Mion, PLLC

(57) ABSTRACT

An image forming apparatus includes an image holding body, a transfer member, and a controller. The image holding body holds an image formed of toner. The transfer member is brought into contact with a continuous medium so as to transfer the image held by the image holding body to the continuous medium, and the transfer member is able to be brought into contact with and separated from the image holding body. The controller causes the transfer member to be separated from the image holding body, and after that, causes the image holding body to move so as to detect an inspection image formed on the image holding body, thereby adjusting, as image quality adjustment, a deviation of a position of the image or a deviation of density of the image to be formed.

4 Claims, 6 Drawing Sheets

(56) References Cited

U.S. PATENT DOCUMENTS 5,592,278 A * 1/1997 Sato ..... G03G 15/164 271/264
5,943,540 A * 8/1999 Okamoto ..... G03G 15/1615 399/302
7,187,893 B2 3/2007 Takahata et al.
2003/0035671 A1* 2/2003 Estabrooks ..... B41J 11/42 399/385
2003/0113128 A1* 6/2003 Matsuduki ..... G03G 15/164 399/66
2006/0062617 A1* 3/2006 Yamasaki ..... G03G 15/5062 399/384
2006/0093409 A1* 5/2006 Kyung ..... G03G 15/0121 399/299
2006/0257181 A1* 11/2006 Takano ..... G03G 15/652 399/384
2007/0059053 A1 3/2007 Namba
2007/0059055 A1 3/2007 Iwata
2007/0297820 A1* 12/2007 Shirakata ..... G03G 15/0131 399/44
2008/0044192 A1* 2/2008 Yagawara ..... G03G 15/5058 399/49
2008/0253786 A1 10/2008 Isobe et al.
2008/0292338 A1* 11/2008 Fujiwara ..... G03G 15/0131 399/44
2008/0317486 A1* 12/2008 Monma ..... G03G 15/0131 399/45
2009/0208267 A1* 8/2009 Matsuduki ..... G03G 15/1685 399/390
2009/0214241 A1* 8/2009 Kawaguchi ..... G03G 15/1615 399/66
2009/0257764 A1 10/2009 Okamoto
2009/0317104 A1 12/2009 Katoh et al.
2009/0317149 A1 12/2009 Takura
2012/0230706 A1 9/2012 Yoshida
2012/0301163 A1* 11/2012 Hirata ..... G03G 15/0131 399/49
2014/0002388 A1 1/2014 Yoshida et al.
2014/0064747 A1* 3/2014 Numazu ..... G03G 15/5062 399/19
2014/0140726 A1* 5/2014 Fukao ..... G03G 15/1615 399/121
2014/0153942 A1* 6/2014 Tokoro ..... G03G 15/0189 399/49
2014/0153945 A1 6/2014 Yoshioka
2014/0175302 A1 6/2014 Touya et al.
2015/0071671 A1* 3/2015 Kiuchi ..... G03G 15/5062 399/72
2015/0086239 A1* 3/2015 Inuzuka ..... G03G 15/1615 399/121
2015/0147099 A1* 5/2015 Tosaka ..... G03G 15/5058 399/301
2015/0168902 A1 6/2015 Sasami
2015/0355584 A1* 12/2015 Ishikawa ..... G03G 15/6517 399/69
2015/0362868 A1* 12/2015 Sone ..... G03G 15/1615 399/49
2016/0041515 A1 2/2016 Numazu et al.
2016/0085195 A1* 3/2016 Uchida ..... G03G 15/5095 399/45
2016/0124343 A1* 5/2016 Sakurai ..... G03G 15/0849 399/58
2016/0161895 A1 6/2016 Sasaki et al.
2016/0378036 A1* 12/2016 Onishi ..... G03G 15/5054 399/302
2017/0060035 A1* 3/2017 Tsuno ..... G03G 15/5058
2017/0075262 A1 3/2017 Ebe et al.
2017/0185022 A1* 6/2017 Tsuda ..... G03G 15/50
2017/0185877 A1 6/2017 Yamada et al.
2017/0199483 A1* 7/2017 Tsuda ..... G03G 15/5041
2017/0308012 A1* 10/2017 Kibayashi ..... G03G 15/2032
2017/0329250 A1* 11/2017 Tanaka ..... G03G 15/0131
2018/0239270 A1* 8/2018 Watanabe ..... G03G 15/0225

FOREIGN PATENT DOCUMENTS

JP 2015-025920 A 2/2015
JP 5710054 B1 4/2015

* cited by examiner

IMAGE FORMING APPARATUS WITH CONTROLLER CONTROLLING FIXING AND TRANSFER MEMBERS

CROSS-REFERENCE TO RELATED APPLICATIONS

This application is a continuation of pending U.S. application Ser. No. 15/592,292, filed May 11, 2017 (now allowed), which is based on and claims priority under 35 USC 119 from Japanese Patent Application No. 2016-189213 filed Sep. 28, 2016, the entire contents of which are incorporated herein by reference.

BACKGROUND

Technical Field

The present invention relates to an image forming apparatus.

SUMMARY

According to an aspect of the present invention, an image forming apparatus includes an image holding body, a transfer member, and a controller. The image holding body holds an image formed of toner. The transfer member is brought into contact with a continuous medium so as to transfer the image held by the image holding body to the continuous medium, and the transfer member is able to be brought into contact with and separated from the image holding body. The controller causes the transfer member to be separated from the image holding body, and after that, causes the image holding body to move so as to detect an inspection image formed on the image holding body, thereby adjusting, as image quality adjustment, a deviation of a position of the image or a deviation of density of the image to be formed.

BRIEF DESCRIPTION OF THE DRAWINGS

Exemplary embodiment of the present invention will be described in detail based on the following figures, wherein:

FIG. 2A illustrates images on the intermediate transfer belt, and FIG. 2B illustrates images on the continuous paper;

FIG. 6A illustrates a first variation, and FIG. 6B illustrates a second variation.

DETAILED DESCRIPTION

Next, an exemplary embodiment as a specific example of an embodiment of the present invention will be described with reference to the drawings. It should be noted that the exemplary embodiment of the present invention is not limited to the following exemplary embodiment.

For ease of understanding of the following description, directions and sides are defined as follows in FIG. 1: the front-rear direction is the X direction, the left-right direction is the Y direction, and the up-down direction is the Z direction; and the directions or sides indicated by arrows X, −X, Y, −Y, Z, and −Z are respectively the front, rear, right, left, upper, and lower directions or sides.

Figure 1:
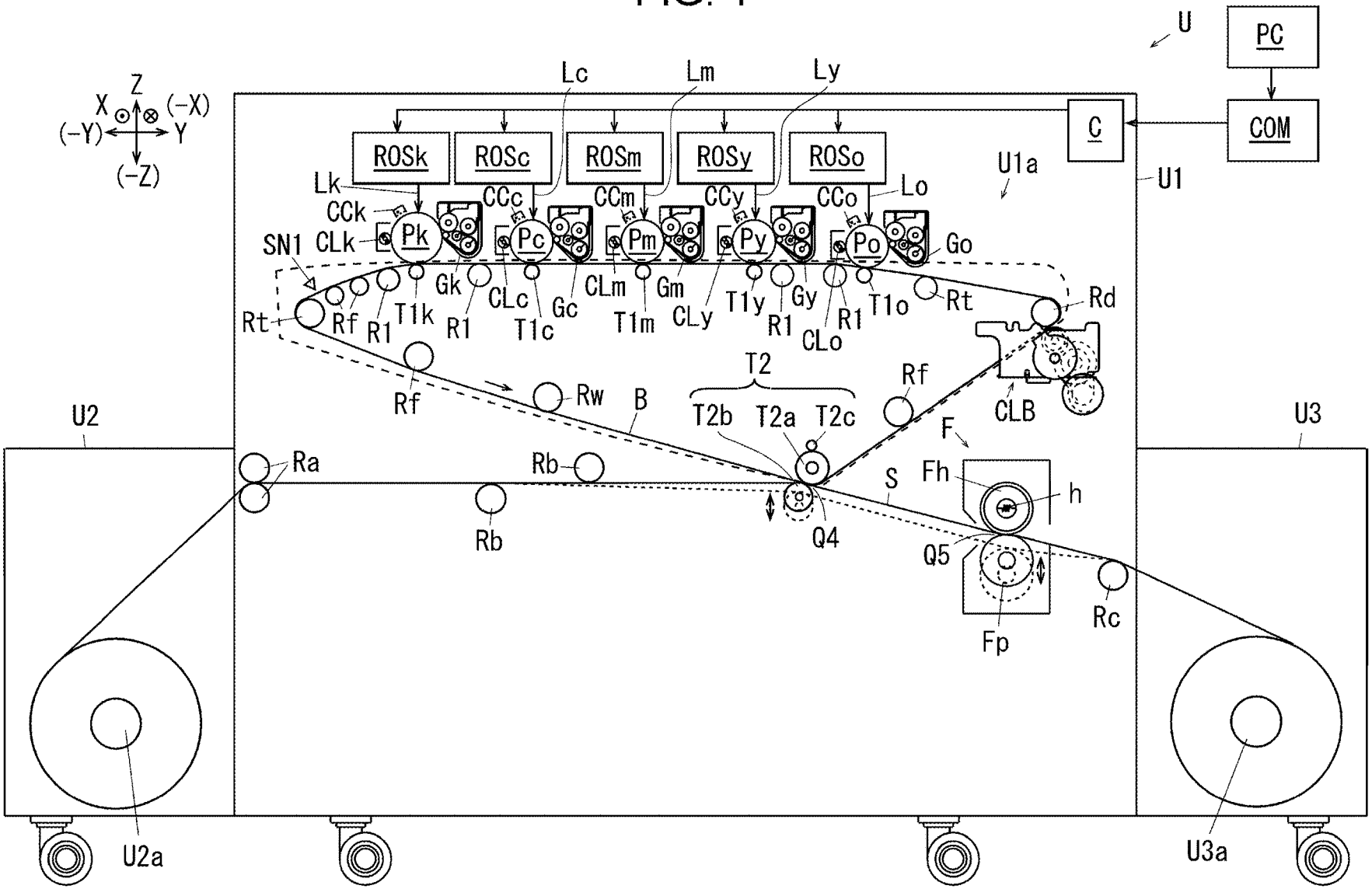
FIG. 1 illustrates the entirety of an image forming apparatus according to an exemplary embodiment.

Also, a circle marked with a dot therein and a circle marked with an "x" therein illustrated in the page of FIG. 1 respectively indicate an arrow extending from the back side to the front side of the page and an arrow extending from the front side to the back side of the page.

It should also be noted that, in the following description with reference to the drawings, elements other than those required for the description are omitted from the drawings as appropriate for ease of understanding.

Exemplary Embodiment

Description of an Overall Structure of a Printer U According to an Exemplary Embodiment FIG. 1 illustrates the entirety of an image forming apparatus according to an exemplary embodiment.

Referring to FIG. 1, a printer U serving as an example of the image forming apparatus according to the exemplary embodiment of the present invention includes a printer body U1, a feeder unit U2, and a collecting unit U3. The feeder unit U2 serving as an example of a feeder feeds a medium to the printer body U1. The collecting unit U3 serving as an example of a collector collects the medium in which an image is recorded.

Description of a Structure of a Marking Section According to the Exemplary Embodiment Referring to FIG. 1, the printer body U1 includes components such as a controller C, a communication unit (not illustrated), and a marking section U1*a*. The controller C controls the printer U. The communication unit receives image information transmitted from a print image server COM. The print image server COM serving as an example of an information transmission device is disposed outside the printer U and connected to the communication unit through a dedicated cable (not illustrated). The marking section U1*a* serving as an example of an image recording section records an image in a medium. A personal computer PC serving as an example of an image transmission device is connected to the print image server COM through a wireless or wired communication circuit and transmits the image information to be printed by the printer U.

The marking section U1*a* includes photosensitive bodies Py, Pm, Pc, Pk, and Po. Each of the photosensitive bodies Py, Pm, Pc, and Pk serves as an example of an image holding body for a corresponding one of yellow (Y), magenta (M), cyan (C), and black (K) colors. The photosensitive body Po is used to form, for example, an image using glossy toner that gives a glossy appearance to the image such as a photographic image.

Referring to FIG. 1, the following components are arranged around the black photosensitive body Pk in a rotational direction of the photosensitive body Pk: a charger CCk, a light exposure device ROSk serving as a latent image forming device, a developing device Gk, a first transfer roller T1*k* serving as an example of a first transfer device, and a photosensitive body cleaner CLk serving as an example of a cleaner for an image holding body.

Likewise, chargers CCy, CCm, CCc, and CCo, light exposure devices ROSy, ROSm, ROSc, and ROSo, developing devices Gy, Gm, Gc, and Go, first transfer rollers T1*y*, T1*m*, T1*c*, and T1*o*, and photosensitive-body cleaners CLy, CLm, CLc, and CLo are arranged around the other photosensitive bodies Py, Pm, Pc, and Po, respectively.

An intermediate transfer belt B serving as an example of an intermediate transfer body and an example of an image holding body is disposed below the photosensitive bodies Py to Po. The intermediate transfer belt B is interposed between the photosensitive bodies Py to Po and first transfer rollers T1*y* to T1*o*. A rear surface of the intermediate transfer belt B is supported by the following rollers: a drive roller Rd serving as an example of a drive member; tension rollers Rt serving as examples of a tension applying member; a walking roller Rw serving as an example of a walking preventive member; plural idle rollers Rf serving as examples of a follower member; a backup roller T2*a* serving as an example of a facing member for second transfer; plural retract rollers R1 serving as examples of a movable member; and the first transfer rollers T1*y* to T1*o*.

A belt cleaner CLB serving as an example of a cleaner for the intermediate transfer body is disposed near the drive roller Rd on a front surface side of the intermediate transfer belt B.

A second transfer roller T2*b* serving as an example of a transfer member and an example of a second transfer member faces the backup roller T2*a* with the intermediate transfer belt B interposed therebetween. The second transfer roller T2*b* according to the exemplary embodiment is in contact with the intermediate transfer belt B at a position shifted toward the upstream side in the rotational direction of the intermediate transfer belt B from a lower end of the intermediate transfer belt B which is at substantially the center of a portion of the intermediate transfer belt B stretched along the backup roller T2*a*. Furthermore, the second transfer roller T2*b* according to the exemplary embodiment is pressed toward the backup roller T2*a* by a spring (not illustrated) serving as an example of an urging member.

Furthermore, in order to apply to the backup roller T2*a* a voltage of an opposite polarity to the polarity to which developers are charged, a contact roller T2*c* serving as an example of a contact member is in contact with the backup roller T2*a*.

A second transfer unit T2 according to the exemplary embodiment includes the backup roller T2*a*, the second transfer roller T2*b*, and the contact roller T2*c*. Transfer devices T1, B, T2 according to the exemplary embodiment include the first transfer rollers T1*y* to T1*o*, the intermediate transfer belt B, the second transfer unit T2, and so forth.

A paper feed member U2*a* is rotatably supported by the feeder unit U2. A continuous paper S serving as an example of a continuous medium is wound so as to be in the form of a roll around the paper feed member U2*a*. The continuous paper S extending from the paper feed member U2*a* is nipped between transport rollers Ra that serve as examples of a transport member and are disposed at an entrance of the printer body U1. Plural guide rollers Rb serving as examples of a guide member are disposed on the right side of the transport rollers Ra. The guide rollers Rb according to the exemplary embodiment each have a rotatable roller shape.

A fixing device F is disposed downstream of the second transfer roller T2*b* in a transport direction of the continuous paper S. The fixing device F includes a heating roller Fh serving as an example of a heating member and a pressure roller Fp serving as an example of a pressure member. A heater h serving as an example of a heat source is housed in the heating roller Fh.

A guide roller Rc serving as an example of a guide member is rotatably disposed downstream of the fixing device F. A wind-up roller U3*a* serving as an example of a collecting member is disposed in the collecting unit U3 collecting unit U3 downstream of the guide roller Rc. The continuous paper S is wound up on the wind-up roller U3*a*. The wind-up roller U3*a* is driven by a motor (not illustrated) serving as an example of a drive source.

Marking Operation

Upon reception of the image information transmitted from the personal computer PC through the print image server COM, the printer U starts a job that is an image forming operation. When the job is started, the photosensitive bodies Py to Po, the intermediate transfer belt B, and so forth are rotated.

The photosensitive bodies Py to Po are rotated by drive sources (not illustrated).

A preset voltage is applied to each of the chargers CCy to CCo so as to charge surfaces of the photosensitive bodies Py to Po.

The light exposure devices ROSy to ROSo output laser beams Ly, Lm, Lc, Lk, and Lo serving as examples of latent image drawing light in accordance with control signals from the controller C so as to draw electrostatic latent images on the charged surfaces of the photosensitive bodies Py to Po.

The developing devices Gy to Go develop the electrostatic latent images on the surfaces of the photosensitive bodies Py to Po into visible images.

A first transfer voltage having the opposite polarity to the polarity to which the developers are charged is applied to each of the first transfer rollers T1*y* to T1*o* so as to transfer the visible image on the surface of a corresponding one of the photosensitive bodies Py to Po onto the surface of the intermediate transfer belt B.

The photosensitive-body cleaners CLy to CLo clean the surfaces of the photosensitive bodies Py to Po by removing the developers remaining on the surfaces of the photosensitive bodies Py to Po after first transfer has been performed.

The images are sequentially transferred onto the intermediate transfer belt B in the order of O, Y, M, C, and K so as to be superposed one on top of another when the intermediate transfer belt B passes through first transfer regions facing the photosensitive bodies Py to Po. Then, the intermediate transfer belt B passes through a second transfer region Q4 facing the second transfer unit T2. For a monochrome image, an image of a single color is transferred and advanced to the second transfer region Q4.

The transfer rollers Ra transport the continuous paper S extending from the feeder unit U2 toward the downstream side. The guide rollers Rb guide the continuous paper S to the second transfer region Q4.

The second transfer unit T2 transfers the images from the intermediate transfer belt B onto the continuous paper S by applying a second transfer voltage to the backup roller T2*a* through the contact roller T2*c*. The second transfer voltage has the same polarity as the preset polarity to which the developers are charged.

The fixing device F heats and applies pressure to the continuous paper S passing through a fixing region Q5 where the heating roller Fh and the pressure roller Fp are in contact with each other. Thus, unfixed images are fixed onto the front side of the continuous paper S.

The continuous paper S onto which the images have been fixed is wound on the wind-up roller U3*a*.

Description of the Fixing Device F and the Second Transfer Roller T2*b*

The fixing device F according to the exemplary embodiment allows the heating roller Fh serving as an example of a first fixing member and the pressure roller Fp serving as an example of a second fixing member to be brought into contact with and separated from each other. In the fixing device F according to the exemplary embodiment, the pressure roller Fp is movable between a contact position where the pressure roller Fp is in contact with the heating roller Fh as indicated by a solid line illustrated in FIG. 1 and a separated position where the pressure roller Fp is separated from the heating roller Fh as indicated by a broken line illustrated in FIG. 1.

Furthermore, according to the exemplary embodiment, as is the case with the pressure roller Fp, the second transfer roller T2*b* serving as the example of the transfer member is also able to be brought into contact with and separated from the intermediate transfer belt B serving as the example of the image holding body. The second transfer roller T2*b* according to the exemplary embodiment is movable between a contact position where the second transfer roller T2*b* is in contact with the intermediate transfer belt B as indicated by a solid line illustrated in FIG. 1 and a separated position where the second transfer roller T2*b* is separated from the intermediate transfer belt B as indicated by a broken line illustrated in FIG. 1.

Description of a Reading Member and Images

Figure 2A:
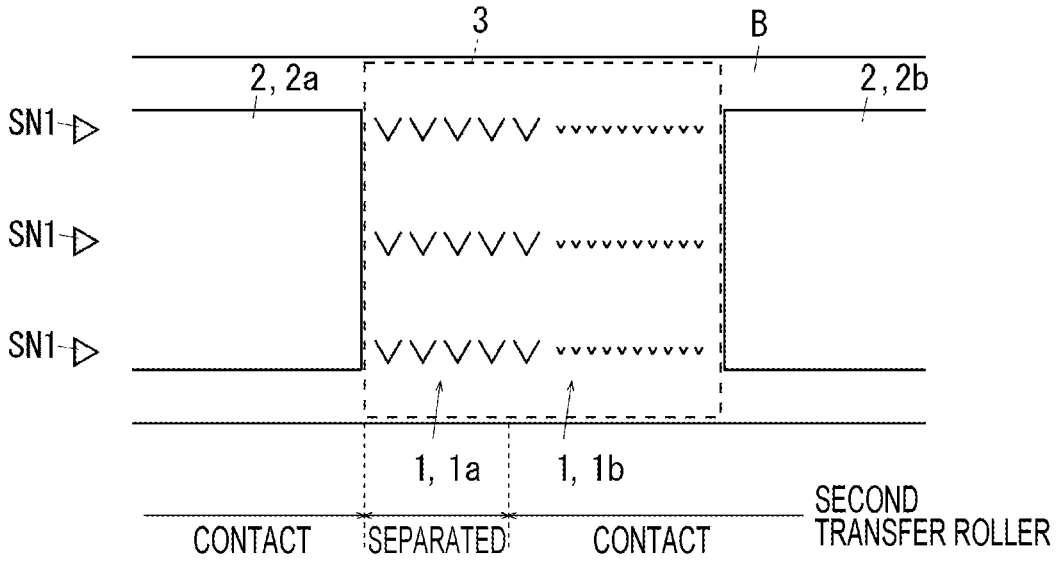
FIGS. 2A and 2B illustrate examples of an image quality adjustment image and a reading member according to the exemplary embodiment, and out of FIGS. 2A and 2B.
Figure 2B:
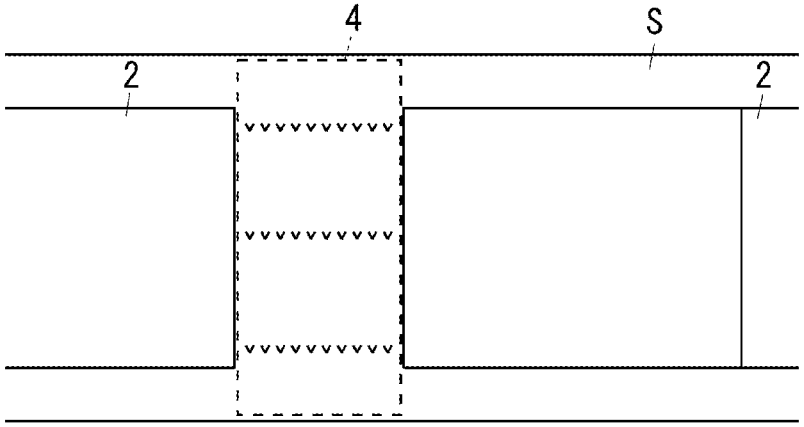

FIGS. 2A and 2B illustrate examples of image quality adjustment image and a reading member according to the exemplary embodiment. Out of FIGS. 2A and 2B, FIG. 2A illustrates images on the intermediate transfer belt, and FIG. 2B illustrates images on the continuous paper.

Referring to FIG. 2A, when adjustment of the positions of the images which serves as an example of the image quality adjustment is performed in the printer U according to the exemplary embodiment, registration control patches 1 serving as examples of the image quality adjustment image are formed. According to the exemplary embodiment, when the image quality adjustment is performed, images held by the intermediate transfer belt B serving as the example of the image holding body is read by position sensors SN1 serving as examples of the reading member. According to the exemplary embodiment, the position sensors SN1 are disposed at both end portions of the intermediate transfer belt B in the width direction. According to the exemplary embodiment, the position sensors SN1 are disposed, in the rotational direction of the intermediate transfer belt B, downstream of the photosensitive body Pk for the K color and upstream of the second transfer region Q4.

Referring to FIG. 2A, according to the exemplary embodiment, the registration control patches 1 are formed at both end portions of the intermediate transfer belt B in the width direction. Specifically, according to the exemplary embodiment, the registration control patches 1 are formed in a region 3 between an image region 2*a* of a preceding print image and an image region 2*b* of a following print image in the transport direction of the intermediate transfer belt B.

Each of the registration control patches 1 is a V-shaped image serving as an example of a predetermined shape projecting in the width direction. These V-shaped images are formed for each of the Y, M, C, and K colors. That is, shapes each having sides which are inclined relative to the transport direction of the intermediate transfer belt B (sub-scanning direction) and the width direction of the intermediate transfer belt B (main scanning direction) are used as the registration control patches 1 according to the exemplary embodiment.

Furthermore, the height of the V shape of the registration control patches 1 according to the exemplary embodiment increases in accordance with a process of positional adjustment to be performed. In other words, either rough adjustment patches 1*a* having a large height V shape, that is, a large V shape or a fine adjustment patches 1*b* having a small height V shape, that is, a small V shape are formed. For example, the rough adjustment patches 1*a* have a larger V shape than that of the fine adjustment patches 1*b* so as to allow adjustment in large ranges. In contrast, the fine adjustment patches 1*b* have a small V shape. This allows the number of the fine adjustment patches 1*b* to be formed per fixed area to increase compared to the rough adjustment patches 1*a*. Accordingly, when the fine adjustment patches 1*b* are used, finer adjustment is possible than with the rough adjustment patches 1*a* and adjustment accuracy is improved. When only the fine adjustment patches 1*b* are used, due to the small V shape, deviations exceeding adjustable ranges are not successfully adjusted. However, use of the rough adjustment patches 1*a* together with the fine adjustment patches 1*b* allows the deviations to be adjusted in large ranges.

According to the exemplary embodiment, the registration control patches 1 are readable by the position sensors SN1.

Description of the Controller According to the Exemplary Embodiment

Figure 3:
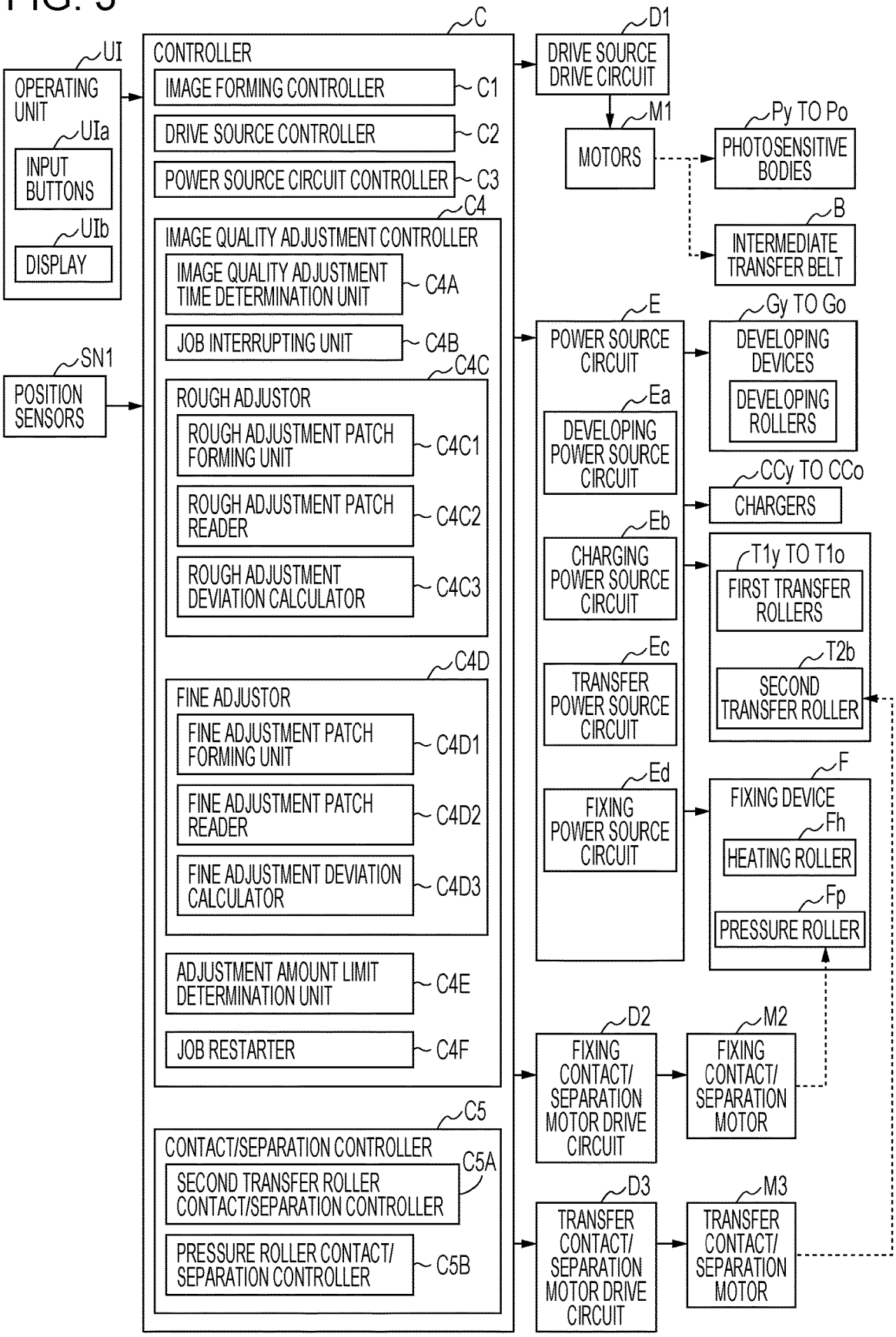
FIG. 3 is a block diagram of the functions of a controller of the image forming apparatus according to the exemplary embodiment.

FIG. 3 is a block diagram of the functions of the controller of the image forming apparatus according to the exemplary embodiment.

Referring to FIG. 3, the controller C of the printer U includes an input/output interface I/O through which the image forming apparatus, for example, receives signals from or outputs signals to the external device. The controller C also includes a read-only memory (ROM) in which programs, information, and so forth for performing required processes are stored. The controller C also includes a random access memory (RAM) where required data is temporarily stored. The controller C also includes a central processing unit (CPU) that performs processes in accordance with the programs stored in, for example, the ROM. Accordingly, the controller C according to the exemplary embodiment includes a small-sized information processing device, that is, a so-called microcomputer. Accordingly, the controller C is able to realize various functions by executing the programs stored in, for example, the ROM.

Signal Output Elements Connected to the Controller C

The controller C receives signals output from signal output elements such as an operating unit UI and the position sensors SN1.

The operating unit UI includes input buttons UIa such as arrow buttons and numeric buttons with which inputting is performed. The input buttons UIa each serve as an example of an input member. The operating unit UI also includes, for example, a display UIb serving as an example of a notifying member.

The position sensors SN1 read the registration control patches 1 held by the intermediate transfer belt B.

Control Target Elements Connected to the Controller C

The controller C is connected to a drive source drive circuit D1, a fixing contact/separation motor drive circuit D2, a transfer contact/separation motor drive circuit D3, a power source circuit E, and other non-illustrated control elements. The controller C outputs to the circuits such as D1 to D3 and E control signals for these circuits.

D1: The Drive Source Drive Circuit

The drive source drive circuit D1 drives the photosensitive bodies Py to Po, the intermediate transfer belt B, and so forth for rotation through motors M1 serving as examples of a drive source.

D2: The Fixing Contact/Separation Motor Drive Circuit

The fixing contact/separation motor drive circuit D2 drives a fixing contact/separation motor M2 so as to cause the pressure roller Fp and the heating roller Fh to be brought into contact with and separated from each other.

D3: The Transfer Contact/Separation Motor Drive Circuit

The transfer contact/separation motor drive circuit D3 drives a transfer contact/separation motor M3 so as to cause the second transfer roller T2*b* and the intermediate transfer belt B to be brought into contact with and separated from each other.

E: The Power Source Circuit

The power source circuit E includes a developing power source circuit Ea, a charging power source circuit Eb, a transfer power source circuit Ec, a fixing power source circuit Ed, and so forth.

Ea: The Developing Power Source Circuit

The developing power source circuit Ea applies a developing voltage to a developing roller of each of the developing devices Gy to Go.

Eb: The Charging Power Source Circuit

The charging power source circuit Eb applies a charging voltage to each of the chargers CCy to CCo so as to charge the surfaces of the photosensitive bodies Py to Po.

Ec: The Transfer Power Source Circuit

The transfer power source circuit Ec applies transfer voltages to the first transfer rollers T1*y* to T1*k* and the backup roller T2*a*.

Ed: The Fixing Power Source Circuit

The fixing power source circuit Ed supplies power to the heater disposed in the heating roller Fh of the fixing device F.

Functions of the Controller C

The controller C performs processes in accordance with input signals from the signal output elements so as to output control signals to the control target elements. That is, the controller C has the following functions.

C1: An Image Forming Controller

An image forming controller C1 controls, for example, driving of the members of the printer U and timing of applying the voltages to the members of the printer U in accordance with the image information input thereto from the print image server COM. Thus, execution, ending, and interruption of the job which is the image forming operation are controlled.

C2: A Drive Source Controller

A drive source controller C2 controls drive of the motor M1 through the drive source drive circuit D1 so as to control drive of, for example, the photosensitive bodies Py to Po.

C3: A Power Source Circuit Controller

A power source circuit controller C3 controls the power source circuits Ea to Ed so as to control the voltages applied to the members and power supplied to the members.

C4: An Image Quality Adjustment Controller

An image quality adjustment controller C4 includes units C4A to C4F. The image quality adjustment controller C4 forms the registration control patches 1 so as to control operation of adjustment of the positions of the images which serves as the example of the image quality adjustment, that is, so as to control operation of registration control. Although only the registration control according to the exemplary embodiment is described below, the image quality adjustment is not limited to the registration control. For example, as the example of the image quality adjustment, any or all of, for example, the following processes are able to be performed: process control in which deviations in the density of images to be formed are adjusted; a developer discharge process in which degraded developers are discharged; and a toner recovery process in which, when the amounts of developers for the developing devices Gy to Go become insufficient, the developing devices Gy to Go are replenished with the developers while the developers are agitated. It is possible that the registration control and the process control are simultaneously performed. Instead, start times for the processes may be independently set for each of the processes and the processes are independently performed when the respective start times arrive.

C4A: An Image Quality Adjustment Time Determination Unit

An image quality adjustment time determination unit C4A determines whether or not a time at which registration control serving as the example of the image quality adjustment is performed has arrived. According to the exemplary embodiment, as an example, the time at which the registration control using the rough adjustment patches 1*a* and the fine adjustment patches 1*b* is performed is set to a time when the power is turned on. Furthermore, a fine adjustment process which is registration control only with the fine adjustment patches 1*b* is set to be performed for every 100 times of printing. Furthermore, the registration control with the rough adjustment patches 1*a* and the fine adjustment patches 1*b* is set to be performed in the case where, when the fine adjustment process is performed, the deviation in position exceeds an adjustable upper limit of the fine adjustment. Accordingly, the image quality adjustment time determination unit C4A determines the time at which the registration control is performed has arrived every time the accumulated number of times of printing reaches 100.

C4B: A Job Interrupting Unit

A job interrupting unit C4B interrupts the job through the image forming controller Cl when it is determined that the time at which the image quality adjustment is performed has arrived while the job is being executed.

C4C: A Rough Adjustor

A rough adjustor C4C serving as an example of an image quality adjustor includes a rough adjustment patch forming unit C4C1, a rough adjustment patch reader C4C2, and a rough adjustment deviation calculator C4C3. The rough adjustor C4C adjusts the positions of images in accordance with a result of reading the registration control patches 1. Specifically, the rough adjustor C4C according to the exemplary embodiment adjusts drawing timing at which images of the light exposure devices ROSy to ROSo are drawn so that, in accordance with the result of reading the rough adjustment patches 1*a*, rough adjustment deviations which are deviations between the positions of images having been read and the target positions at which the images are to be drawn become zero. Because of use of the rough adjustment patches 1*a*, the unit of detectable deviations is larger than that with the fine adjustment patches 1*b*. Thus, compared to the case where the fine adjustment patches 1*b* are used, the adjustment is rough. That is, rough adjustment is performed.

C4C1: The Rough Adjustment Patch Forming Unit

The rough adjustment patch forming unit C4C1 serving as an example of a positional adjustment image forming unit forms the rough adjustment patches 1*a* when the registration control using the rough adjustment patches 1*a* is started.

C4C2: The Rough Adjustment Patch Reader

The rough adjustment patch reader C4C2 reads the positions of the rough adjustment patches 1*a* through the position sensors SN1.

C4C3: The Rough Adjustment Deviation Calculator

The rough adjustment deviation calculator C4C3 calculates deviations between the positions read by the rough adjustment patch reader C4C2 and the target positions as the rough adjustment deviations. The rough adjustment deviations are calculated for the Y, M, C, K, and O images.

C4D: A Fine Adjustor

A fine adjustor C4D serving as an example of the image quality adjustor includes a fine adjustment patch forming unit C4D1, a fine adjustment patch reader C4D2, and a fine adjustment deviation calculator C4D3. The fine adjustor C4D adjusts the positions of images in accordance with the result of reading the registration control patches 1. Specifically, the fine adjustor C4D according to the exemplary embodiment adjusts drawing timing at which images of the light exposure devices ROSy to ROSo are drawn so that, in accordance with the result of reading the fine adjustment patches 1*b*, fine adjustment deviations which are deviations between the positions of images having been read and the target positions at which the images are to be drawn become zero. Because of use of the fine adjustment patches 1*b*, the unit of detectable deviations is smaller than that with the rough adjustment patches 1*a*. Thus, compared to the case where the rough adjustment patches 1*a* are used, the adjustment is fine. That is, fine adjustment is performed.

C4D1: The Fine Adjustment Patch Forming Unit

The fine adjustment patch forming unit C4D1 serving as an example of the positional adjustment image forming unit forms the fine adjustment patches 1*b* when the registration control using the fine adjustment patches 1*b* is started.

C4D2: The Fine Adjustment Patch Reader

The fine adjustment patch reader C4D2 reads the positions of the fine adjustment patches 1*b* through the position sensors SN1.

C4D3: The Fine Adjustment Deviation Calculator

The fine adjustment deviation calculator C4D3 calculates deviations between the positions read by the fine adjustment patch reader C4D2 and the target positions as the fine adjustment deviations. The fine adjustment deviations are calculated for the Y, M, C, K, and O images.

C4E: An Adjustment Amount Limit Determination Unit

An adjustment amount limit determination unit C4E determines whether or not the adjustment amounts during the fine adjustment reach limits of the deviations adjustable by the fine adjustment. The adjustment amount limit determination unit C4E according to the exemplary embodiment determines that the limits are reached when the fine adjustment deviations calculated by the fine adjustment deviation calculator C4D3 become the limits of the deviations or larger.

C4F: A Job Restarter

When the image quality adjustment operation ends, a job restarter C4F restarts the interrupted job through the image forming controller C1.

C5: A Contact/Separation Controller

A contact/separation controller C5 includes a second transfer roller contact/separation controller C5A and a pressure roller contact/separation controller C5B. The contact/separation controller C5 controls contact and separation of the second transfer roller T2*b* serving as the example of the transfer member and the pressure roller Fp serving as the example of the fixing member.

C5A: The Second Transfer Roller Contact/Separation Controller

The second transfer roller contact/separation controller C5A causes the second transfer roller T2*b* to be brought into contact with and separated from the intermediate transfer belt B through the transfer contact/separation motor drive circuit D3. The second transfer roller contact/separation controller C5A according to the exemplary embodiment causes the second transfer roller T2*b* to be separated from the intermediate transfer belt B while the rough adjustment is being performed during the image quality adjustment operation. The second transfer roller contact/separation controller C5A according to the exemplary embodiment causes the second transfer roller T2*b* to be brought into contact with the intermediate transfer belt B while the job is being executed or the fine adjustment is being performed. Furthermore, according to the exemplary embodiment, in order to address performing of the image quality adjustment operation that includes the rough adjustment performed when the power is turned on, the second transfer roller T2*b* is caused to be separated from the intermediate transfer belt B when the job ends.

C5B: The Pressure Roller Contact/Separation Controller

The pressure roller contact/separation controller C5B causes the pressure roller Fp to be brought into contact with and separated from the heating roller Fh through the fixing contact/separation motor drive circuit D2. The pressure roller contact/separation controller C5B according to the exemplary embodiment causes the contact and separation of the pressure roller Fp to be performed at timing adjusted to timing of the contact/separation of the second transfer roller T2*b*.

Description of a Flowchart According to the Exemplary Embodiment

Next, procedure of control of the printer U according to the exemplary embodiment is described with reference to a schematic representation of a sequence of operations, that is, a flowchart.

Figure 4:
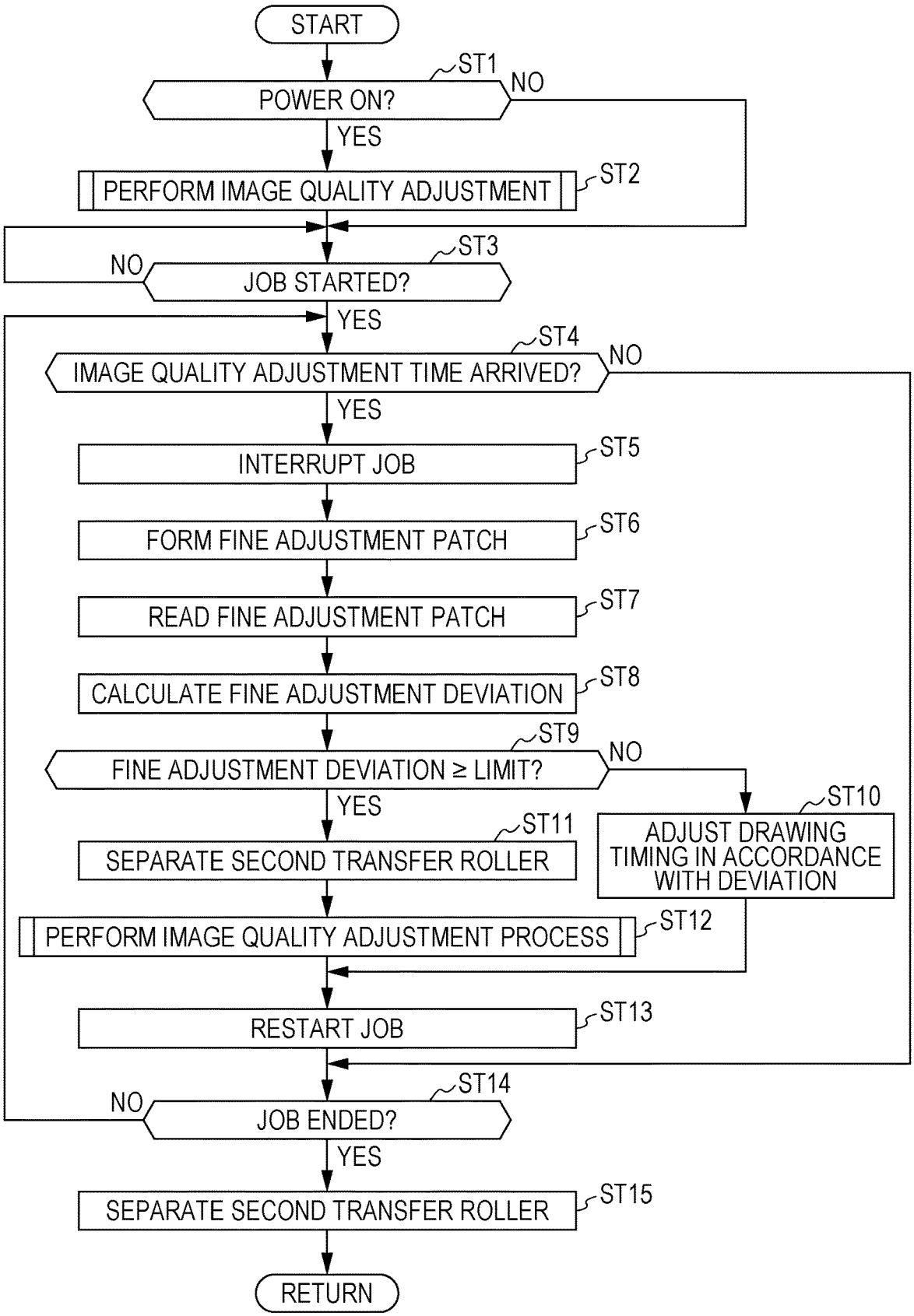
FIG. 4 illustrates a flowchart of a determination process for performing image quality adjustment according to the exemplary embodiment.

Description of a Flowchart of a Determination Process for Performing Image Quality Adjustment FIG. 4 illustrates a flowchart of a determination process for performing the image quality adjustment according to the exemplary embodiment.

Processes in the steps STs of the flowchart illustrated in FIG. 4 are performed in accordance with the programs stored in the controller C of the printer U. Furthermore, these processes are performed in parallel with performing of various other processes of the printer U.

The processes of the flowchart illustrated in FIG. 4 are started with turning on the power of the printer U.

In ST1 illustrated in FIG. 4, if the power is turned on or not is determined. If the power is turned on ("YES"), processing advances to ST2. If the power is not turned on ("NO"), the processing advances to ST3.

In ST2, an image quality adjustment process in which image quality is adjusted with the registration control patches 1 is performed. The image quality adjustment process will be described later with reference to FIG. 5. Then, the processing advances to ST3.

In ST3, if the job has been started or not is determined. If the job has been started ("YES"), the processing advances to ST4. If the job has not been started ("NO"), ST3 is repeated.

In ST4, if the time at which the image quality is adjusted has arrived or not is determined. According to the exemplary embodiment, whether or not the accumulated number of times of printing on sheets has reached 100 is determined. If the time at which the image quality is adjusted has arrived ("YES"), the processing advances to ST5. If the time at which the image quality is adjusted has not arrived ("NO"), the processing advances to ST14.

In ST5, the job being executed is interrupted, and the processing advances to ST6.

In ST6, the fine adjustment patches 1*b* are formed. Then, the processing advances to ST7.

In ST7, the fine adjustment patches 1*b* are read by the position sensors SN1. Then, the processing advances to ST8.

In ST8, the fine adjustment deviations are calculated. Then, the processing advances to ST9.

In ST9, if the fine adjustment deviations are equal to or larger than the limits or smaller than the limits is determined. If the fine adjustment deviations are smaller than the limits ("NO"), the processing advances to ST10. If the fine adjustment deviations are equal to the limit or larger ("YES"), the processing advances to ST11.

In ST10, drawing timing for the light exposure devices ROSy to ROSo is adjusted in accordance with the fine adjustment deviations. Then, the processing advances to ST13.

In ST11, the second transfer roller T2*b* is moved to a separated position. That is, the second transfer roller T2*b* is separated from the intermediate transfer belt B. At this time, the pressure roller Fp is also moved to a separated position. Then, the processing advances to ST12.

In ST12, the image quality adjustment process in which image quality is adjusted with the registration control patches 1 is performed. The image quality adjustment process will be described later with reference to FIG. 5. Then, the processing advances to ST13.

In ST13, the job having been interrupted is restated. Then, the processing advances to ST14.

In ST14, if the job has ended or not is determined. If the job has ended ("YES"), the processing advances to ST15. If the job has not ended ("NO"), the processing returns to ST4.

In ST15, the second transfer roller T2*b* is moved to the separated position. Then, the processing returns to ST1.

Description of a Flowchart of the Image Quality Adjustment Process

Figure 5:
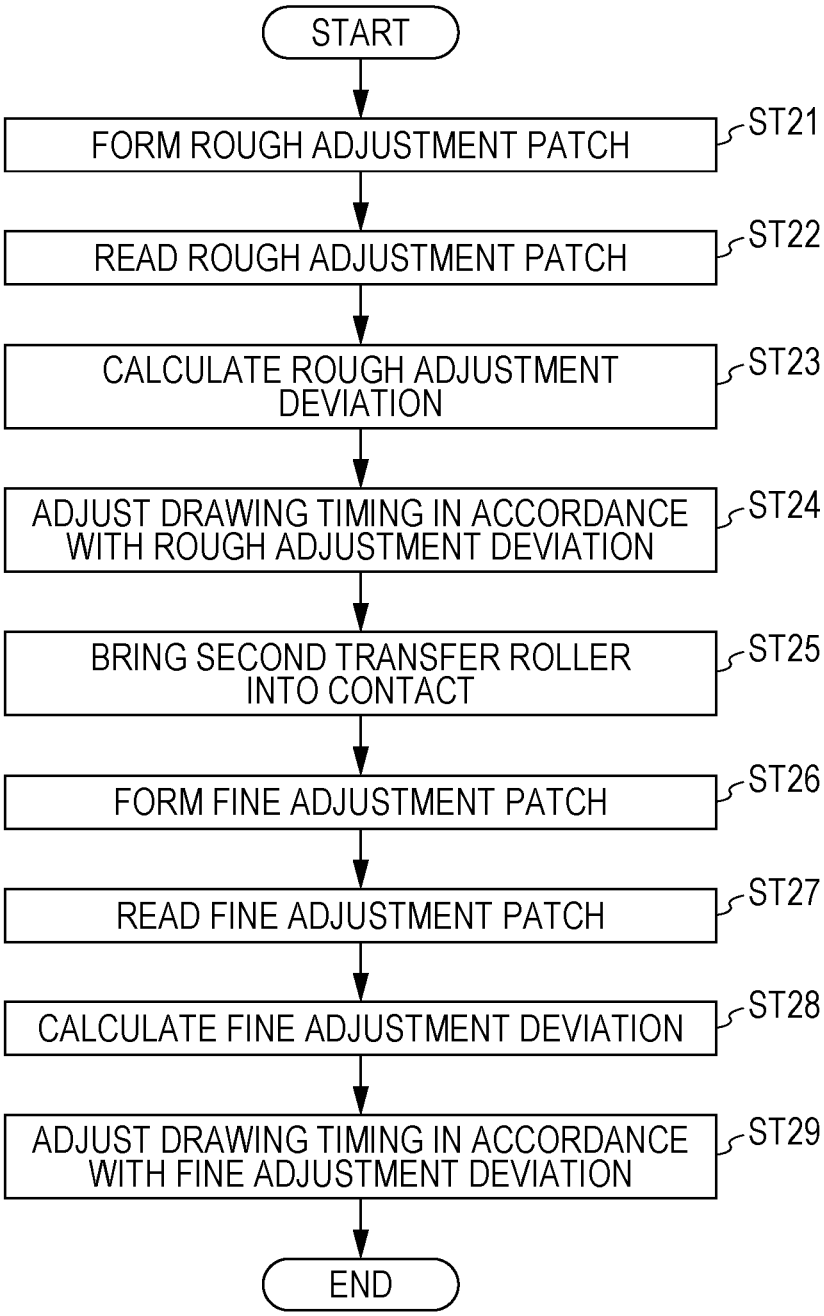
FIG. 5 illustrates a flowchart of the image quality adjustment process according to the exemplary embodiment, explaining the processes in ST2 and ST12 illustrated in FIG. 4.

FIG. 5 illustrates a flowchart of the image quality adjustment process according to the exemplary embodiment, explaining the processes in ST2 and ST12 illustrated in FIG. 4.

In ST21 illustrated in FIG. 5, the rough adjustment patches 1*a* are formed. Then, the processing advances to ST22.

In ST22, the rough adjustment patches 1*a* are read by the position sensors SN1. Then, the processing advances to ST23.

In ST23, the rough adjustment deviations are calculated. Then, the processing advances to ST24.

In ST24, drawing timing for each of the light exposure devices ROSy to ROSo is adjusted in accordance with the rough adjustment deviations. Then, the processing advances to ST25.

In ST25, the second transfer roller T2*b* is moved to the contact position. Then, the processing advances to ST26.

In ST26, the fine adjustment patches 1*b* are formed. Then, the processing advances to ST27.

In ST27, the fine adjustment patches 1*b* are read by the position sensors SN1. Then, the processing advances to ST28.

In ST28, the fine adjustment deviations are calculated. Then, the processing advances to ST29.

In ST29, drawing timing for the light exposure devices ROSy to ROSo is adjusted in accordance with the fine adjustment deviations. Then, the image quality adjustment process illustrated in FIG. 5 ends, and the processing returns to the determination processes of performing the image quality adjustment illustrated in FIG. 4.

Operations of the Exemplary Embodiment

The image quality adjustment process is performed when the power is turned on in the printer U according to the exemplary embodiment having the above-described structure. In the image quality adjustment process, first, the rough adjustment patches 1*a* are formed and the rough adjustment is performed while the second transfer roller T2*b* is separated from the intermediate transfer belt B. Then, the fine adjustment patches 1*b* are formed and the fine adjustment is performed while the second transfer roller T2*b* is in contact with the intermediate transfer belt B.

There exists related art in which, when the image quality is adjusted, the second transfer roller T2*b* is not separated from the intermediate transfer belt B. When media having a preset size such as the A4 size, that is, so-called cut sheets are used, it is possible to adjust the image quality while feeding of the cut sheets is stopped or form the registration control patches in a space between a preceding cut sheet and a following cut sheet. However, when the continuous paper S is used, a movement of the second transfer roller T2*b* to the contact position causes the continuous paper S to be transported toward the downstream side and the registration control patches 1 formed on the intermediate transfer belt B to be transferred onto the continuous paper S. Accordingly, there arises a problem with the related art in that paper is wasted and spoiled corresponding to a patch forming region 3 illustrated in FIG. 2A.

In contrast, according to the exemplary embodiment, during the rough adjustment with the rough adjustment patches 1*a*, the second transfer roller T2*b* is separated from the intermediate transfer belt B. Accordingly, as illustrated in FIG. 2B, a region 4 of the continuous paper S in which the registration control patches 1 are transferred is reduced. Thus, compared to the case where the second transfer roller T2*b* is not moved to the separated position during the image quality adjustment, spoiling of paper may be reduced.

Furthermore, according to the exemplary embodiment, during the fine adjustment with the fine adjustment patches 1*b*, the second transfer roller T2*b* is moved to the contact position. During the job of forming an image on the continuous paper S, the second transfer roller T2*b* is in contact with the intermediate transfer belt B. Members that support the intermediate transfer belt B and forces that act on the intermediate transfer belt B while the second transfer roller T2*b* is in contact with the intermediate transfer belt B are different from members that support the intermediate transfer belt B and forces that act on the intermediate transfer belt B while the second transfer roller T2*b* is separated from the intermediate transfer belt B. Thus, even when the second transfer roller T2*b* is separated during the registration control, positional deviations may occur when the second transfer roller T2*b* is brought into contact.

In contrast, according to the exemplary embodiment, the second transfer roller T2*b* is moved to the contact position when the fine adjustment is performed, and image forming is performed in a state in which the fine adjustment has been performed. Thus, compared to the case where the second transfer roller T2*b* is separated during the fine adjustment, the positional deviations, that is, degradation of image quality may be reduced. According to the exemplary embodiment, the rough adjustment is performed while the second transfer roller T2*b* is separated. The positional deviations may occur when the second transfer roller T2*b* is brought into contact after the rough adjustment. However, in this case, the degree of the positional deviations is not large, and, in most cases, such positional deviations are adjustable by the fine adjustment. Thus, according to the exemplary embodiment, degradation of image quality may be reduced while reducing spoiling of paper.

Furthermore, according to the exemplary embodiment, when the time at which the image quality adjustment is performed arrives during the job, the image quality adjustment process including the rough adjustment is performed in the case where the deviations are larger than the deviations adjustable by the fine adjustment. Accordingly, compared to the case where the image quality adjustment including the rough adjustment is necessarily performed while performing of the job, a time period required to perform the image quality adjustment may be reduced. This may also increase the number of prints per unit time, that is, so-called productivity.

Furthermore, according to the exemplary embodiment, the pressure roller Fp is also brought into contact and separated in accordance with the contact/separation of the second transfer roller T2*b*. Thus, transportation of the continuous paper S by the fixing device F is reduced. This may reduce spoiling of paper. Furthermore, soiling of and damaging to the continuous paper S due to rubbing of the continuous paper S being transported against the second transfer roller T2*b* and the pressure roller Fp may be reduced.

Furthermore, according to the exemplary embodiment, the second transfer roller T2*b* and the pressure roller Fp are moved to the respective separated positions when the job ends. This may reduce, during stoppage of transportation of the continuous paper S, the likelihood of the continuous paper S creasing due to a force received by the continuous paper S, the continuous paper S being burned due to heat from the heating roller Fh, and the continuous paper S being subjected to thermal deformation and thermal discoloration due to heat from the heating roller Fh in the second transfer region Q4 and the fixing region Q5.

Variations of the Exemplary Embodiment

Figure 6A:
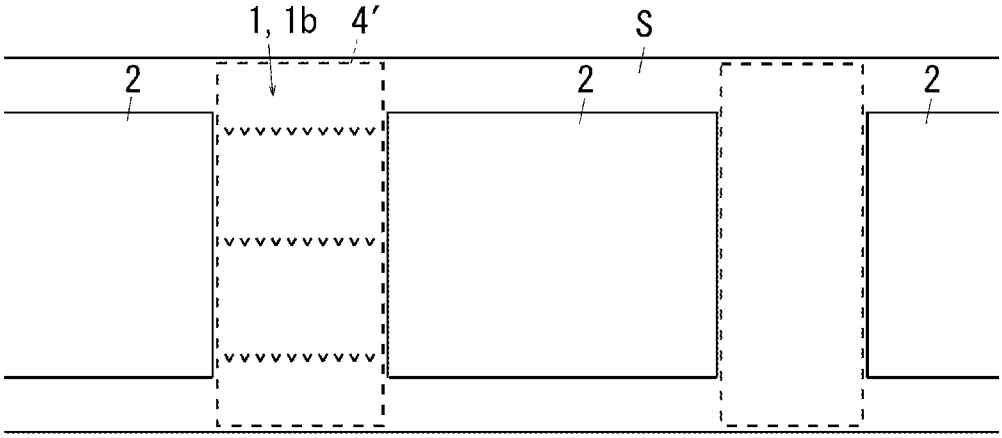
FIGS. 6A and 6B illustrate variations of registration control patches according to the exemplary embodiment, and out of FIGS. 6A and 6B.
Figure 6B:
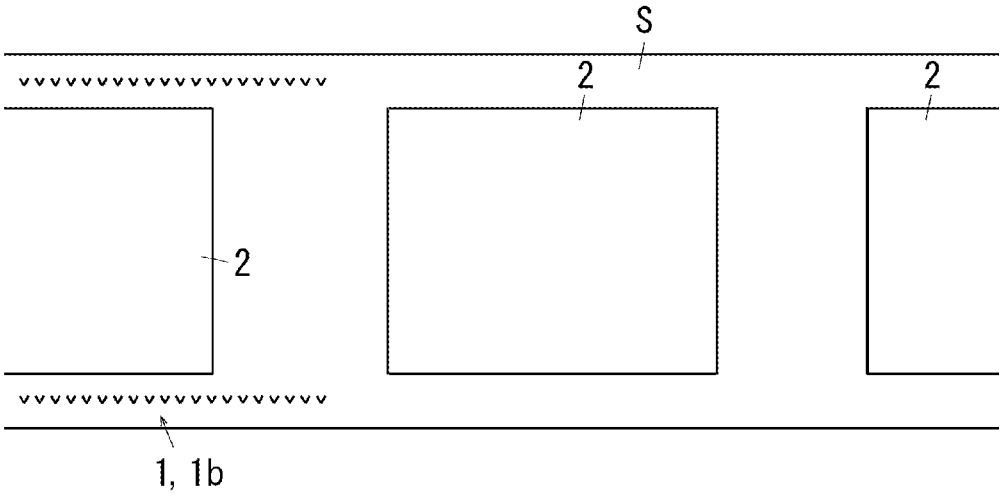

FIGS. 6A and 6B illustrate variations of the registration control patches according to the exemplary embodiment. Out of FIGS. 6A and 6B, FIG. 6A illustrates a first variation, and FIG. 6B illustrates a second variation.

In the above-described example, the registration control patches 1 according to the exemplary embodiment are formed while the job is being interrupted. However, this is not limiting. For example, as illustrated in FIG. 6A, in the case where a region 4' to be abandoned after printing has been performed similarly to a cut portion is set in the continuous paper S, the time at which the image quality adjustment is performed is able to be set so as to transfer the fine adjustment patches 1*b* onto the region to be abandoned 4'.

Furthermore, as illustrated in FIG. 6B, in the case where only the fine adjustment is performed by forming only the fine adjustment patches 1*b* without forming the rough adjustment patches 1*a*, the fine adjustment patches 1*b* are able to be transferred to regions outside regions of images 2 in the width direction. In this case, with respect to the positions where the position sensors SN1 are disposed, the rough adjustment patches 1*a* are also able to be formed outside the images 2 in the width direction. When the rough adjustment patches 1*a* are formed, in the case where the second transfer roller T2*b* is separated, forming the rough adjustment patches 1*a* at positions in the middle in the sub-scanning direction of the images 2 leads to separation of the second transfer roller T2*b* in the middle of the images 2. This may in turn lead to stopping of transportation, and accordingly, there may arise a problem in the images 2. Thus, in this case, the rough adjustment patches 1*a* may be formed in a space between the images 2 (an inter-image region 4 or the region to be abandoned 4').

Modifications

Although the details of the exemplary embodiment of the present invention have been described, the above-described exemplary embodiment of the present invention is not limiting. Modifications (H01 to H09) of the exemplary embodiment of the present invention are listed below.

H01: The printer U is described as the example of the image forming apparatus according to the exemplary embodiment. However, the image forming apparatus is not limited to this. For example, the image forming apparatus may be a copier, a facsimile machine, a multifunction machine that includes plural or all of the functions out of these functions, or the like.

H02: Although the developers of the four colors are used for the example of the printer U according to the exemplary embodiment, this is not limiting. For example, the image forming apparatus may be a monochrome image forming apparatus or a multi-color image forming apparatus for which three or less colors or five or more colors are used.

H03: Although the second transfer roller T2*b* having a roller shape is described as the example of the transfer member according to the exemplary embodiment, this is not limiting. For example, a belt-shaped transfer member may be used. Likewise, although the intermediate transfer belt B having a belt shape is described as the example of the image holding body, this is not limiting. A drum-shaped intermediate transfer body may be used. Furthermore, a monochrome image forming apparatus having the structure as described below may be used: the monochrome image forming apparatus includes no intermediate transfer body. Instead, the transfer roller is brought into contact with and separated from the photosensitive body serving as an example of the image holding body.

H04: Although the adjustment of the positions of the images is described as the example of the image quality adjustment according to the exemplary embodiment, this is not limiting. As has been described, adjustment of density, discharge of degraded developers, toner recovery, and so forth may be performed. In addition, an operation such as measurement of electrical resistance of the second transfer roller T2*b* may be performed. Furthermore, although the second transfer roller T2*b* is separated during the rough adjustment in the example according to the exemplary embodiment, the second transfer roller T2*b* may be separated when the adjustment of density, the discharge of degraded developers, or the toner recovery is performed.

H05: Although the images 1*a* and 1*b* having V shapes are used as the examples of the image quality adjustment image according to the exemplary embodiment, this is not limiting. Images of an arbitrary shape, for example, a polygon such as a triangle or a combination of line segments such as a crisscross or an x-shaped mark may be used.

H06: According to the exemplary embodiment, the time at which the deviations in the fine adjustment reach the limits when the power is turned on is described as the example of the time at which the image quality adjustment is performed. However, this is not limiting. The time at which the image quality adjustment is performed may be arbitrarily changed to, for example, any of the following times: every time when the job is started; every time the job ends; and a preset time (for example, 8 a.m.). Furthermore, when the region to be abandoned is provided as illustrated in FIGS. 6A and 6B, the fine adjustment may be performed every time printing corresponding to a single sheet of paper is performed. In addition, the image quality adjustment may be performed when multi-color printing is performed after a job of monochrome printing has been performed. That is, during the monochrome printing, positional deviations of color images themselves are not a problem and only the first transfer roller T1*k* for black is in contact with the intermediate transfer belt B. However, during the multi-color printing, the plural first transfer rollers T1*y* to T1*o* are in contact with the intermediate transfer belt B. This changes a stretching state of the intermediate transfer belt B. Accordingly, it is possible that the adjustment of the position is not performed during the monochrome printing, and when operation is changed to the multi-color printing, the adjustment of the positions is performed.

H07: According to the exemplary embodiment, the pressure roller Fp may also be moved in accordance with the movement of the second transfer roller T2*b*. However, this is not limiting. The pressure roller Fp is not necessarily separated. Likewise, when transportation of the continuous paper S is stopped, although the second transfer roller T2*b* and the pressure roller Fp may be separated from the intermediate transfer belt B and the heating roller Fh, the second transfer roller T2*b* and the pressure roller Fp may be in contact with the intermediate transfer belt B and the heating roller Fh.

H08: Although the second transfer roller T2*b* may be in contact during the fine adjustment according to the exemplary embodiment, the fine adjustment may be performed while the second transfer roller T2*b* is kept separated depending on, for example, the allowable deviations.

H09: Although the continuous paper is described as the example of the medium according to the exemplary embodiment, the medium is not limited to paper. For example, a film formed of resin may be used.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding body that holds an image formed of toner;

a transfer member that is brought into contact with a continuous medium so as to transfer the image held by the image holding body to the continuous medium and that is able to be brought into contact with and separated from the image holding body;

a controller that causes the transfer member to be separated from the image holding body, and after that, causes the image holding body to move so as to detect an inspection image formed on the image holding body, thereby adjusting, as image quality adjustment, a deviation of a position of the image or a deviation of density of the image to be formed; and a fixing device configured to fix an image that has been transferred to the medium onto the medium, wherein the fixing device incudes a heating member and a pressure member, wherein the controller controls in such a manner that the transfer member and the image holding body are moved to corresponding contact positions or corresponding retract positions, wherein the controller unit controls in such a manner that the heating member and the pressure member are moved to corresponding contact positions or corresponding retract positions, wherein the heating member and the pressure member are contacted or separated in accordance with the contacting or separating of the transfer member and the image holding body even if a controller does not carry out the image quality adjustment operation, and wherein the controller is configured to control such that the inspection image is transferred by the transfer member to regions outside regions of normal images in a width direction, and in regions between the regions of normal images, in the case where the image holding body and the transfer member are in the contact position.

2. The image forming apparatus according to claim 1, wherein the heating member and the pressure member are separated when the job ends.

3. The image forming apparatus according to claim 1, wherein the controller is further configured to control the transfer member to contact the image holding body, and after that, causes the image holding body to move so as to detect a second inspection image formed on the image holding body, thereby adjusting, as image quality adjustment, a deviation of a position of the image or a deviation of density of the image to be formed.

4. The image forming apparatus according to claim 1, wherein the controller is further configured to form a rough adjustment patch and perform a rough adjustment of the deviation of a position of the image or the deviation of density of the image to be formed when in the retract position, and to form a fine adjustment patch and perform a fine adjustment of the deviation of a position of the image for the deviation of the density of the image to be formed when in the contact position.

* * * * *